US011969076B2

(12) United States Patent
Liesch

(10) Patent No.: US 11,969,076 B2
(45) Date of Patent: Apr. 30, 2024

(54) CONVERTIBLE SHOULDER BAG AND BACKPACK

(71) Applicant: David Liesch, Vancouver (CA)

(72) Inventor: David Liesch, Vancouver (CA)

( * ) Notice: Subject to any disclaimer, the term of this patent is extended or adjusted under 35 U.S.C. 154(b) by 165 days.

(21) Appl. No.: 17/761,969

(22) PCT Filed: Sep. 21, 2020

(86) PCT No.: PCT/CA2020/051263
§ 371 (c)(1),
(2) Date: Mar. 18, 2022

(87) PCT Pub. No.: WO2021/051209
PCT Pub. Date: Mar. 25, 2021

(65) Prior Publication Data

US 2022/0408902 A1 Dec. 29, 2022

(30) Foreign Application Priority Data

Sep. 20, 2019 (CA) ..... CA 3056080

(51) Int. Cl.
*A45F 4/02* (2006.01)
*A45F 3/02* (2006.01)
*A45F 3/04* (2006.01)

(52) U.S. Cl.
CPC ..... *A45F 3/047* (2013.01); *A45F 3/02* (2013.01); *A45F 2003/025* (2013.01); *A45F 2003/045* (2013.01)

(58) Field of Classification Search
CPC ..... A45F 2004/023; A45F 3/047; A45F 2003/142; A45F 4/02; A45F 3/02; A45F 3/04; A45C 2009/007; A45C 9/00
See application file for complete search history.

(56) References Cited

U.S. PATENT DOCUMENTS 2,902,195 A * 9/1959 Marshall ..... A01K 97/20 224/608
4,273,274 A * 6/1981 Freistadt ..... A45F 3/04 150/108
4,887,751 A * 12/1989 Lehman ..... A45F 3/04 190/110
5,431,317 A * 7/1995 Kliot ..... A45F 3/04 224/259
5,577,652 A 11/1996 Cooper
(Continued)

*Primary Examiner* — Adam J Waggenspack

(57) ABSTRACT

A convertible shoulder bag and backpack includes: (a) a bag body defining front, back, top, bottom, first side, and second side panels; and (b) a strap defining first and second portions thereof extending between first and second pairs of connection points for connecting the first and second portions to the bag body, respectively. An interconnecting portion slidably extends between a pair of diagonally opposing connection points such that slidably increasing the length of the first portion decreases the length of the second portion and vice versa, the strap being configured to enable the convertible shoulder bag and backpack to be converted between a shoulder-bag configuration and a backpack configuration without disconnecting or reconnecting the strap. The strap may include a retractable hip belt and/or securing strap. Additionally, a tote handle may be coupled to the first and/or second portion by a length-multiplying interconnecting portion.

24 Claims, 12 Drawing Sheets

(56) References Cited

U.S. PATENT DOCUMENTS

| | | | | |
|---|---|---|---|---|
| 7,160,028 | B1 * | 1/2007 | Linday | A45C 9/00 150/108 |
| 8,950,643 | B2 | 2/2015 | Shen | |
| 9,439,501 | B2 * | 9/2016 | Demskey | A47D 13/025 |
| 9,635,914 | B2 * | 5/2017 | Fujikura | A45C 13/26 |
| 10,182,640 | B2 * | 1/2019 | Holtz | A45F 4/02 |
| 2005/0236451 | A1 | 10/2005 | Juhlin | |
| 2017/0347766 | A1 | 12/2017 | Chung | |

* cited by examiner

CONVERTIBLE SHOULDER BAG AND BACKPACK

FIELD OF THE INVENTION

The invention relates to the field of bags, including shoulder bags, backpacks, duffle bags, briefcases, laptop cases, messenger bags, handbags, totes, carry-alls, sports bags, golf bags, and other bags that may be suitable for both dual shoulder carry on the back of a person and single shoulder carry at the side of a person, particularly to a single loop strap system that allows for quick and easy conversion between dual shoulder carry and single shoulder carry.

BACKGROUND OF THE INVENTION

There exists a number of dual shoulder and single shoulder carry systems on the market.

A dual shoulder arrangement (or backpack system) is typically used for larger and heavier bags since the two straps provide for an even distribution of weight across two shoulders, thereby making it easier to carry heavier loads and mitigating the potential for strain and injuries to the neck, shoulders and back. In order to add further ergonomic benefits, the dual straps are typically configured in a rough triangular formation to accommodate the differing widths of the neck and waist of the wearer. Dual shoulder carry against the wearer's back also helps to keep the center of gravity of the bag closer to that of the wearer, providing additional ease of carry as well as increased safety when doing physical activities, such as hiking, riding a bicycle, or running to catch a train or flight. To add further ergonomic benefits, heavier bags will typically include a hip belt in order to move the majority of the weight from the shoulders to the hips of the wearer, thereby further mitigating the potential for strains and injuries to the neck, shoulders and back.

One disadvantage of dual shoulder carry is reduced security in that thieves may approach from behind and possibly remove items from the bag while out of sight of the wearer. For a larger backpack, there may also be a risk of the bag bumping into people or objects if the wearer enters a congested area such as a small shop or a train car. In these cases, side-carry may be desirable. Side-carry systems are typically used for smaller and lighter bags for style and aesthetic reasons as well as ease of access to pockets and better security.

In order to potentially optimize between some of the advantages and disadvantages of the two modes of carry described above, a variety of products have been created that allow for conversion between dual shoulder and single shoulder carry. Some products feature separate backpack and side-carry straps that operate independently of one another while others allow for a quicker and easier conversion using a single loop of strap that enables both modes of carry. For some products, the bag is turned 90 degrees when switching between modes. This is typically seen in larger backpacks, duffle bags, briefcases and laptop cases. For a number of other products, the bag orientation is maintained when switching between modes, as is sometimes seen in handbags, totes and carry-ails. Examples of some existing strap designs are described below.

One example of a bag providing two modes of carry is the Patagonia MLC 45. The concept behind this bag is that the backpack straps and side-carry strap are independent of one another. The top ends of the backpack straps are stitched to the bag body within a zippered pocket located on the back panel while the bottom ends of the backpack straps can connect and disconnect near the bottom corners of the back panel using quick release fasteners. Both ends of the side-carry strap have quick release fasteners attached and the side-carry strap can therefore be disconnected from the bag when not in use.

The connection points are arranged such that the bag body is turned 90 degrees when switching between backpack and side-carry modes.

To convert from backpack to side-carry (assuming the wearer prefers to store unused straps), the wearer disconnects the bottom ends of the backpack straps from the bag body and then stuffs the backpack straps into the storage pocket on the back panel. The storage pocket zipper may then be pulled to the closed position. The wearer also removes the side-carry strap from a pocket and then connects both ends to fasteners located on one side panel. To switch to backpack mode this process is reversed.

One advantage of this product is the ability to secure all of the straps within pockets when not in use, which may be desirable if the bag needs to be checked in and stored away for a flight, train, or bus ride, or if the bag is carried briefcase style using one of the available grab handles.

An example of a single strap convertible system is Cooper's Convertible Backpack (U.S. Pat. No. 5,577,652). The concept behind this system is that the section of strap used for side-carry is formed using one entire backpack section and the top portion of the other backpack section. This is achieved by employing a single loop of strap that is connected at the ends to two locations near the bottom corners of the back panel, with the center portion of the loop freely passing through a single anchoring loop centered near the top of the back panel.

The connection points and routing are arranged such that the bag body is turned 90 degrees when switching between modes.

To convert from backpack to side-carry, the top end of one of the backpack sections is pulled through the anchoring loop and combines with the other backpack section to form a single longer side-carry section while the now shortened backpack section is pulled tight against the back panel. To switch to backpack mode this process is reversed.

While the Cooper system appears to provide for quick and easy conversion between backpack and side-carry for a smaller/lighter bag, it may not function as well for a heavier bag for the following reasons.

The bag may tilt on an angle when in side-carry mode since the side-carry anchoring points are located on the back panel rather than on a side panel. In addition, the two anchoring points used for side-carry are at different heights on the bag body, one near the center and one near a corner.

A typical feature on most backpacks is to have two independent length adjustment buckles, one on each shoulder strap.

Another typical feature on heavier backpacks is a set of two ergonomic c-shaped or s-shaped shoulder pad sections that provide for comfort and stability when the pack is carried on two shoulders. These sections are typically at least twice the width of the strap material and sometimes made of the same material that is used for the bag body. For heavier bags, these shoulder pads will typically be vented and have softer foam material inside for added comfort.

A third typical feature on heavier backpacks is a sternum strap that connects the two shoulder straps together, thereby further securing the pack and transferring weight load to provide for additional stability and comfort.

The Cooper system does not appear to easily allow for the addition of some or all of the components listed above as some of the components may need to pass through the center anchoring loop when converting between carry modes and may remain exposed on the strap when in side-carry mode. It may be possible to add sliding shoulder pads to this bag, and perhaps locate the bulk of the sternum strap on the side that is at rest while in side-carry mode, but these features may result in slower conversion as the sliding pads may create friction and may need to be readjusted after a conversion.

A second example of a single strap system is Chung's Convertible Strap Handbag (U.S. Patent Application Pub. No. US 2017/0347766 A1). The concept behind this system is that the bottom ends of the section used for side-carry mode are formed using the top ends of the two sections used for backpack mode. This is achieved by employing a single loop of strap that is connected at its ends to two locations near the bottom corners of the back panel, with the center portion of the loop freely passing through two anchoring loops located near the top of the back panel.

The orientation of the bag does not change when switching between the two modes of carry as with the Cooper bag.

To convert from backpack to side-carry, the top portions of both backpack sections are pulled through the two anchoring loops at the top of the bag body, thereby lengthening the side-carry section while shortening both backpack sections and pulling the backpack sections against the back panel. To switch to backpack mode this process is reversed.

The Chung system appears to have some of the same limitations as the Cooper system in terms of bag tilt and difficulty in adding desirable components on the backpack sections, since the connections are again all located on the back panel and the top ends of the backstrap sections must pass through the anchoring loops at the top of the bag when switching between modes of carry. While this system appears to provide for quick and easy conversion between backpack and side-carry for a smaller/lighter bag, it may not function as well for a heavier bag.

A third example of a single strap system is Juhlin's Bag with a Strap (U.S. Patent Application Pub. No. US 2005/0236451 A1). The concept behind this system is that the section of strap used for side-carry is formed using one entire backpack section and the bottom portion of the other backpack section. This is achieved by employing a single loop of strap that is connected at its ends to two locations on the side panel that is at the top of the bag (as viewed in backpack mode), with the center portion of the loop freely passing through a strap transit fitting centered on the opposing bottom side panel.

The connection points and routing are arranged such that the bag body is turned 90 degrees when switching between modes.

To convert from backpack to side-carry, the bottom end of one of the backpack sections is pulled through the strap transit fitting and combines with the other backpack section to form a single longer side-carry section, while the now shortened backpack section is pulled against the side panel that is now at the bottom (as viewed in side-carry mode). To switch to backpack mode this process is reversed.

This system appears to be similar in function to the Cooper and Chung systems described above, but resolves the center of gravity problem for side-carry mode by placing all of the strap connections on two side panels instead of on the back panel. This feature requires that two portions of the strap pivot by 90 degrees and thereby change orientation between back panel and side panel when switching between carry modes.

Similar to the Cooper and Chung systems, one entire backpack section forms a portion of the side-carry section while a portion of the other backpack section is stored against the bag body. For the Juhlin system, the resting backpack section is stored against the bottom side panel (as viewed in side-carry mode). This bottom panel includes support feet that prevent the resting portion of the strap from lying on the floor when the bag is set down in side-carry mode, assuming that there is a snug fit within the strap transit fitting. This feature may work well when setting the bag down on the floor, but if the bag is set down on uneven ground, the strap may become scraped or soiled and any soil may be transferred to the clothing of the wearer when switching to backpack mode. If the bag is set down on the other bottom side panel (as viewed in backpack mode), the strap transit fitting and small portions of the strap on the bottom may be exposed to scrapes and soil as well.

An additional benefit of the support feet may be the ability to prevent the resting portion of the strap from sliding out from its storage position on the bottom side panel and onto the back panel when in side-carry mode. The disadvantage to this is that the strap may need to be manually lifted over the support feet as a separate step when converting between modes. The support feet also may not allow for the addition of typical desirable features on the side panel for backpack mode. Examples of potentially desirable features on the side of a backpack include zippered or unzippered pockets for holding water bottles, umbrellas, cell phones and other items.

The Juhlin system appears to allow for the addition of length adjustment buckles, shoulder pads and sternum strap on the backpack sections since the loop passes through a connection on the bottom panel (as viewed in backpack mode) rather than the top panel as with the Cooper and Chung bags. However, one half of these components would be exposed on one side of the side-carry strap when in side-carry mode while the other half of the components would be exposed on the bottom side panel (as viewed in side-carry mode).

While the Juhlin system appears to provide for quick and easy conversion between backpack and side-carry for a smaller/lighter bag, it may not function as well with some of the additional components needed for a heavier bag.

A fourth example of a single loop system is the Shen Combination Backpack and Over-The-Shoulder Bag (U.S. Pat. No. 8,950,643 B2). The main concept behind this system is that the section of strap used for side-carry is formed using one entire backpack section and the bottom portion of the other backpack section, as with the Juhlin design described above. This is achieved by employing a single loop of strap that is connected at its ends to either one or two locations on the top side of the bag (as viewed in backpack mode), with the center portion of the loop freely passing through two anchoring loops on the opposing bottom side panel.

The connection points and routing are arranged such that the bag body is turned 90 degrees when switching between modes.

To convert from backpack to side-carry, the bottom end of one of the backpack sections is pulled through anchoring loops and combines with the other backpack section to form a single longer side-carry section while the now shortened backpack section is pulled against the bottom side panel (as viewed in side-carry mode). To switch to backpack mode this process is reversed.

The Shen system appears to allow for the addition of length adjustment buckles, shoulder pads and sternum strap on the backpack sections since the loop passes through a connection on the bottom panel (as viewed in backpack mode) rather than the top panel as with the Cooper and Chung bags. However, one half of these components would be exposed on one side of the side-carry strap when in side-carry mode while the other half the components would be exposed on the bottom side panel (as viewed in side-carry mode). If the bag is set down, these components may be exposed to scrapes or soil and any soil may be transferred to the clothing of the wearer when switching to backpack mode. There does not appear to be any means of restraining the unused section of strap that is at rest along the bottom panel (as viewed in side-carry mode), which may result in the strap catching on something or sliding out of position.

The Shen system as drawn shows four connection points that are all located near the bag corners to create a rectangular shape, which works well for a smaller bag. To achieve a more triangular shape for improved ergonomics on a larger bag, the hoops on the top panel could perhaps be moved closer to the center of the top panel (as viewed in backpack mode), however the conversion to side-carry might be more difficult in that scenario. For example, shifting of one strap section from the back panel to the bottom panel may have to be done manually as a separate step in the conversion as the longer section may not easily slide around the bottom corner of the bag. In addition, the added length needed for the resting section may increase the chances of the strap sliding out of position and slipping back onto the back panel, causing the bag body to drop by some degree from the shoulder while in side-carry mode.

While this system appears to provide for quick and easy conversion between backpack and side-carry for a smaller/lighter bag, it may not function as well with some of the additional components needed for a heavier bag.

Despite previous attempts, a need exists for a system for efficiently converting a bag between dual shoulder and single shoulder carry without disconnecting or reconnecting a strap, while allowing for the inclusion of desirable features that provide for better ergonomics, cleanliness, safety and security. Other objects of the invention will be apparent from the description that follows.

SUMMARY OF THE INVENTION

The invention addresses the need for efficiently switching a bag between backpack mode and side-carry mode while also providing a number of other features that are important for safety, comfort and security, a more streamlined bag profile, and reduced exposure of stored sections of strap and hardware.

The concept behind the invention is that the bottom ends of the section of strap employed for side-carry mode are connected to the bottom ends of the two sections of strap employed in backpack mode. This design provides for complete independence between certain key sections of the strap that are most essential to each carry mode. To achieve this, the two sections of strap used for backpack mode have been placed at the ends of a single loop while the single section of strap used for side-carry has been placed at the center of the loop. The invention employs a single loop of strap that is permanently fixed at the ends at two locations centered near the top of the back panel (as viewed in backpack mode), with the center portion of the loop freely passing through four key anchoring points. Two of the key anchoring points are dedicated to the bottom ends of the backpack sections of the loop and are located near the bottom corners of the back panel (as viewed in backpack mode). The other two key anchoring points are dedicated to the bottom ends of the side-carry section of the loop and are placed near the ends and at the center of the top side panel (as viewed in side-carry mode). Given this configuration, the backpack sections of strap located at the ends of the loop remain permanently disposed towards the back panel and the side-carry section of strap located at the center of the loop remains permanently disposed towards the top side panel (as viewed in side-carry mode).

The routing of the strap between the four key anchoring points described above may vary in order to accommodate desirable features disposed around the perimeter of the bag, such as water bottle and umbrella holders, zippered or unzippered pockets, and other features.

The connection points and the routing may be arranged such that the bag body is turned by 90 degrees when switching between modes and may also be arranged such that the bag orientation is maintained when switching between modes.

To convert from backpack to side-carry, the center of the side-carry section is pulled away from its resting place on the side panel. This action draws the bottom ends of the side-carry section upwards through their anchoring points while also drawing both backpack sections downwards through their anchoring points, thereby evenly lengthening the side-carry section while evenly shortening the two backpack sections and pulling them against the back panel.

To convert from side-carry to backpack, the process is reversed in that both backpack sections are pulled away from their resting places on the back panel.

This action draws the bottom ends of the backpack sections upwards through their anchoring points while also drawing both ends of the side-carry section downwards through their anchoring points, thereby evenly lengthening the backpack sections while evenly shortening the two ends of the side-carry section and pulling it against the side panel.

The invention allows for a retractable hip belt for use in backpack mode, two sections of which are permanently attached near the bottom ends of the backpack strap portions of the single loop. The two sections of the hip belt may be extracted along with the bottom ends of the two backpack sections when converting to backpack mode and may be retracted along with the bottom ends of the backpack sections when converting to side-carry and thereby stored flush against the resting portions of the loop. A hip belt is typically used for heavier bags in order to redistribute the majority of the weight from the shoulders to the hips, thereby mitigating the potential for strains and injuries to the neck, shoulders and back.

The invention also allows for length adjustment buckles, a sternum strap, two backpack shoulder pads and one side carry shoulder pad to be fixed in place on the loop, eliminating the need to readjust any components after conversion. Since the shoulder pads are independent of one another, the pads and any cushion materials added may differ in style, shape, and ergonomics between the backpack sections and the side-carry section. In order to provide for optimum weight distribution and comfort, backpack pads are usually c-shaped or s-shaped while side-carry pads tend to be rectangular or oval.

Since the side-carry section of the strap is lengthened evenly from both bottom ends, the single shoulder pad may be fixed in place at the center of the side-carry section of strap, eliminating the need for adjustment after conversion to side-carry. As an alternative, the invention may include a sliding shoulder pad for side-carry if a length adjustment buckle is desired on the side-carry section of the loop.

The invention also allows for reduced exposure of any resting adjustment buckles, shoulder pads and sternum strap by securing these items against the back panel rather than the bottom side panel (as viewed in side-carry mode). This feature protects these components from potential scrapes when the bag is set down on its bottom side (as viewed in side-carry mode) and also keeps everything clean for when those components are returned to the shoulder of the wearer in backpack mode. If air flow vents are added as a feature within an upholstered back panel (a desirable feature for added comfort on heavier bags), the air vents can be shaped to accommodate the shoulder pads and other components and thereby store all components within the upholstered back panel. This feature helps to streamline the bag while in side-carry mode, providing for better aesthetics and security, lower risk of a strap catching on an object and reduced bag thickness to better comply with airline check-in restrictions.

Since the strap is not required to pivot by 90 degrees when converting between modes as with some existing systems, the invention also eliminates exposure of strap and hardware items on the top and bottom sides (as viewed in backpack mode). This feature also streamlines the bag in that it allows for the elimination of some elements of hardware such as metal or plastic hoops and may instead utilize bag panel seams and stitching as anchoring agents. This feature also allows for the use of a sleeve to contain the resting portions of strap, thereby hiding them from view and protecting them against damage and soiling.

The invention also allows for only one loop being exposed on a side of the bag when in side-carry mode rather than two loops as with some existing systems. When the bag needs to be set down on either the back panel or front panel (as may be required for a storage bin or under-seat storage while on a flight, train or bus), this feature may reduce certain risks such as theft, the extra loop catching on something, or the owner inadvertently lifting the bag from the wrong side, potentially causing objects to fall out.

The invention also allows for attaching the loop ends closer to the center of the top of the back panel, thereby creating a triangular strap configuration for backpack mode which is better for ergonomics, weight distribution and stability.

According to the present invention there is provided a convertible shoulder bag and backpack. The bag includes a bag body having a front panel, a back panel, a bottom panel, a first side panel, a second side panel opposite the first side panel, and a top panel opposite the bottom panel. The bag also includes a plurality of connection points positioned on the bag body and a strap with first and second ends. The first and second ends are fixedly attached to the bag body adjacent the first side panel and a portion of the strap between the first and the second ends is slideably connected to said bag body at at least one connection point.

The strap is configured to enable a wearer to alternate between a shoulder-bag configuration and a backpack configuration without disconnecting or reconnecting said strap. The strap may include a shoulder pad, at least one backpack pad, a retractable hip belt and a securing strap.

In one embodiment, in the shoulder-bag configuration, a portion of the strap used in the backpack configuration may rest along the back panel and when in the backpack configuration, a portion of the strap used in the shoulder-bag configuration may rest along the top panel.

In the same or another embodiment, in the shoulder-bag configuration a portion of the strap used in the backpack configuration may not be used as a portion of the strap in the shoulder-bag configuration and when in the backpack configuration, a portion of the strap used in the shoulder-bag configuration may not be used as a portion of the strap in the backpack bag configuration.

In the same or another embodiment, to convert the bag into the shoulder-bag configuration a portion of the strap may be pulled away from the top panel and to convert the bag into the backpack configuration a portion of the strap may be pulled away from the back panel.

In the same or another embodiment, a portion of the strap between the first and the second ends of the strap may be slideably connected to the bag body at at least one connection point adjacent the top panel and at at least one connection point adjacent the second side panel so that the strap is configured to enable a wearer to alternate between a shoulder-bag configuration and a backpack configuration without disconnecting or reconnecting the strap.

In another embodiment, a portion of the strap between the first and second ends may be slideably connected to the bag body at first and second connection points positioned adjacent the top panel and at a third connection point positioned adjacent the second side panel.

In another embodiment, a portion of the strap between the first and second ends may be slideably connected to the bag body at a first connection point positioned adjacent the first side panel, a second connection point positioned adjacent the second side panel, and a third connection point positioned adjacent the bottom panel.

In another embodiment, a convertible shoulder bag and backpack includes: (a) a bag body defining a front panel, a back panel opposite the front panel, a bottom panel, a top panel opposite the bottom panel, a first side panel, and a second side panel opposite the first side panel; and (b) a strap comprising first and second ends, the first and second ends being fixedly attached to the bag body adjacent at least one of the first side panel and the back panel, wherein a portion of the strap between the first and the second ends is slideably connected to the bag body at a first connection point positioned on the bag body adjacent at least one of the top panel and the first panel, the portion being slideably connected to the bag body at a second connection point positioned on the bag body adjacent at least one of the top panel and the second side panel, the strap being configured to enable a wearer to alternate the convertible shoulder bag and backpack between a shoulder-bag configuration and a backpack configuration without disconnecting or reconnecting the strap.

The strap may include a retractable hip belt. The strap may include a shoulder pad. The strap may include at least one backpack pad. The strap may include a securing strap. The portion may be slideably connected to the bag body at a third connection point positioned on the bag body adjacent at least one of the back panel, the bottom panel, and the second side panel. The third connection point may be positioned in proximity to the second side panel adjacent at least one of the back panel and the bottom panel. The third connection point may be positioned adjacent the second side panel. The third connection point may be positioned adjacent the back panel. The third connection point may be positioned adjacent the bottom panel. When in the shoulder-bag configuration, a second portion of the strap used in the backpack configuration may rest along the back panel. When in the backpack configuration, a third portion of the strap used in the shoulder-bag configuration may rest along the top panel. The second portion may be used other than as the third portion. The third portion may be used other than as the second portion. To convert the bag into the backpack configuration, the second portion may be pulled away from the back panel. To convert the bag into the shoulder-bag configuration, the third portion may be pulled away from the top panel. To convert the bag into the backpack configuration, a second portion of the strap may be pulled away from the back panel. To convert the bag into the shoulder-bag configuration, a third portion of the strap may be pulled away from the top panel.

In another embodiment, a convertible shoulder bag and backpack includes: (a) a bag body defining a front panel, a back panel opposite the front panel, a top panel extending between the front and back panels, a bottom panel opposite the top panel, a first side panel extending between the front and back panels, and a second side panel opposite the first side panel; and (b) a strap defining a first portion thereof extending between a first pair of connection points for connecting the first portion to the bag body, the strap defining a second portion thereof extending between a second pair of connection points for connecting the second portion to the bag body, the first and second portions being connected to each other via an interconnecting portion slidably extending between a pair of diagonally opposing the connection points such that slidably increasing the length of the first portion decreases the length of the second portion and slidably increasing the length of the second portion decreases the length of the first portion, the strap being configured to enable the convertible shoulder bag and backpack to be converted between a shoulder-bag configuration and a backpack configuration without disconnecting or reconnecting the strap.

The strap may include a retractable hip belt. The strap may include a securing strap. The first portion may be shorter than the second portion when the convertible shoulder bag and backpack is in the shoulder-bag configuration. The first and second portions may be substantially equal in length when the convertible shoulder bag and backpack is in the backpack configuration. The first pair of connection points may include a first one of the connection points fixedly connecting the strap to the bag body. The first connection point may be disposed proximate to an edge extending between the back panel and the first side. The first pair of connection points may include a second one of the connection points slidably connecting the strap to the bag body. The second connection point may be disposed proximate to a corner defined between the back panel, the second side panel, and the bottom panel. The second pair of connection points may include third and fourth the connection points. One of the third and fourth connection points may be fixedly attached to the bag body. The third connection point may be proximate to the edge. The other of the third and fourth connection points may slidably connect the strap to the bag body. The fourth connection point may be disposed proximate to a second corner defined between the back panel, the second side panel, and the top panel. The strap may define a shoulder-strap portion thereof extending between a third pair of connection points for connecting the shoulder-strap portion to the bag body. The shoulder-strap portion may be connected to the first and second portions such that slidably increasing the length of said shoulder-strap portion decreases the length of said first and second portions and slidably increasing the combined length of said first and second portions decreases the length of said shoulder-strap portion. The shoulder-strap portion may be longer than the length of each of the first and second portions when the convertible shoulder bag and backpack is in the shoulder-strap configuration. The third pair of connection points may be respectively disposed in proximity to opposing ends of the top panel. The first pair of connection points may include a first one of the connection points fixedly connecting the strap to the bag body. The first connection point may be disposed proximate to an edge extending between the back panel and the first side. The second pair of connection points may include a second one of the connection points disposed proximate to the edge and fixedly connecting the strap to the bag body. The first pair of connection points may include a third one of the connection points slidably connecting the strap to the bag body. The third connection point may be disposed proximate to a corner defined between the back panel, the second side panel, and the bottom panel. The second pair of connection points may include a fourth one of the connection points slidably connecting the strap to the bag body. The fourth connection point may be disposed proximate to a second corner defined between the back panel, the second side panel, and the top panel. The first and second portions may be connected to each other via a second interconnecting portion slidably extending between a second pair of diagonally opposing connection points opposite the pair of diagonally opposing connection points. Each of the connection points of the first and second pair of connection points may slidably connect the strap to the bag body. The first pair of connection points may include a first one of the connection points disposed proximate to an edge extending between the back panel and the first side. The first pair of connection points may include a second one of the connection points disposed proximate to a corner defined between the back panel, the second side panel, and the bottom panel. The second pair of connection points may include a third one of the connection points disposed proximate to the edge. The second pair of connection points may include a fourth one of the connection points disposed proximate to a second corner defined between the back panel, the second side panel, and the top panel. The first and second connection points may be formed by a single connection point. The convertible shoulder bag and backpack may further include a tote strap defining a tote handle thereof. The tote handle may extend between a third pair of connection points for connecting the tote handle to the bag body. The tote strap may be connected to the first and second portions such that slidably increasing the combined lengths of the first and second portions by an amount decreases the length of the tote handle by a diminished amount less than the amount and slidably increasing the length of the tote handle by a tote amount decreases the combined lengths of the first and second portions by a magnified amount greater than the tote amount.

In another embodiment, a convertible tote bag includes: a length of pliant material or a series of lengths of pliant material and components connected together defining at least two tote handles; said at least two tote handles defining two distal ends; one of said distal ends being connected to one of said panels and one of said distal ends being connected to another of said panels such that slidably increasing the length of one tote handle by a first amount decreases the length of at least one other tote handle by an amount equal to or greater than said first amount; said at least two tote handles being configured to enable the convertible tote bag to be converted between a first tote bag configuration and a second tote bag configuration without disconnecting or reconnecting any components.

In another embodiment, a convertible tote bag includes: (a) a bag body defining a front panel, a back panel opposite the front panel, a top panel extending between the front and back panels, a bottom panel opposite the top panel, a first side panel extending between the front and back panels, and a second side panel opposite the first side panel; (b) a first strap defining a first portion thereof extending between a first pair of connection points for connecting the first portion to the bag body, the first portion comprising at least one of a shoulder-strap portion and a first backpack portion; and (c) a second strap defining a tote handle thereof extending between a second pair of connection points for connecting the tote handle to the bag body, the first and second second straps being connected to each other via an interconnecting portion slidably extending between the first and second pairs of connection points such that slidably increasing the length of the tote handle a first amount decreases the length of the first portion by a magnified amount greater than the first amount and slidably increasing the length of the first portion by a second amount decreases the length of the tote handle by a diminished amount less than the second amount, the convertible tote bag being convertible between a tote-bag configuration and at least one of a shoulder-bag configuration and a backpack configuration without disconnecting or reconnecting either of the first and second straps.

The interconnecting portion may include first and second segments thereof. The first segment may terminate in a bifurcating member slidably coupled to the second segment such that the second segment is folded by the bifurcating member when the bifurcating member is moved by the first segment in a direction away from the second segment. The convertible tote bag may include a restraint fixedly attached to the bag body for restraining the second segment when the bifurcating member is moved in the direction. The convertible tote bag may further include a plurality of cascading pairs of the first and second segments such that the second segment of one of the pairs is the first segment of a subsequent one of the pairs. The magnified amount may be eight times the first amount. The magnified amount may be four times the first amount. The second strap may define a first one of the tote handles disposed at the top panel and a second one of the tote handles disposed at the first side panel. The first portion may include the first backpack portion, the first strap defining a second portion thereof extending between a second pair of connection points for connecting the second portion to the bag body. The first and second portions may be connected to each other via an interconnecting portion slidably extending between a pair of diagonally opposing connection points such that slidably increasing the length of the first portion decreases the length of the second portion and slidably increasing the length of the second portion decreases the length of the first portion. The first strap may be configured to enable the convertible tote bag to be converted between a shoulder-bag configuration and a backpack configuration without disconnecting or reconnecting the first strap.

Other aspects of the invention will be appreciated by reference to the detailed description of the preferred embodiment and to the claims that follow.

BRIEF DESCRIPTION OF THE DRAWINGS

Embodiments of the invention will be described by reference to the drawings thereof in which.

DESCRIPTION OF THE PREFERRED EMBODIMENTS OF THE INVENTION

Figure 1:
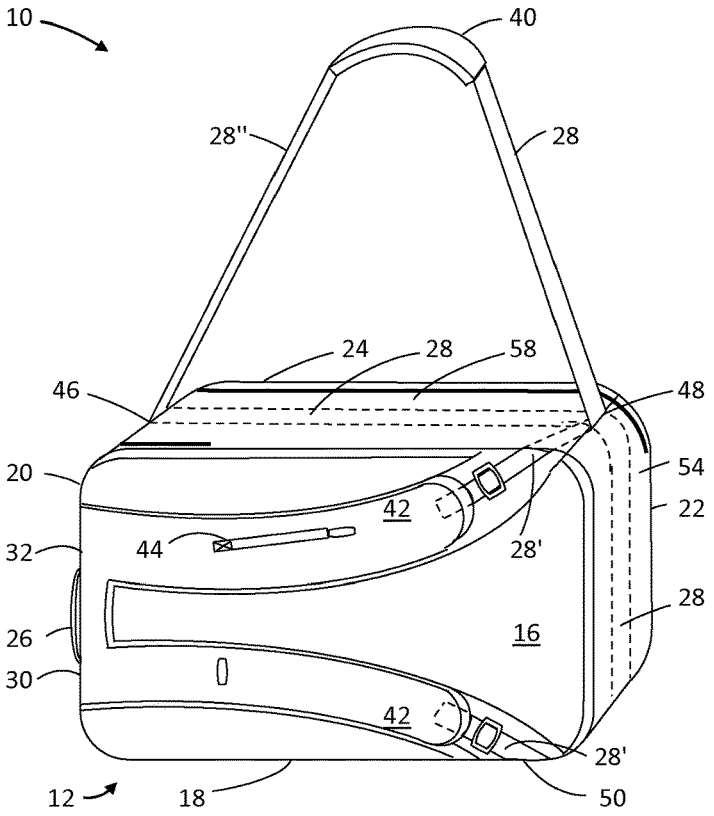
FIG. 1 is a perspective view of a convertible shoulder bag and backpack showing an embodiment of the invention in a shoulder-bag configuration.

Referring to all of the figures, there is provided a convertible shoulder bag and backpack 10. The bag 10 includes a bag body 12 having a front panel 14, a back panel 16, a bottom panel 18, a first side panel 20, a second side panel 22 opposite the first side panel 20, and a top panel 24 opposite the bottom panel 18. The bag 10 also includes a plurality of connection points positioned on the bag body 12 and a continuous strap 28 with first 30 and second ends 32. The first 30 and second 32 ends of the strap 28 are fixedly attached to the bag body 12 adjacent the first side panel 20 and a portion of the strap 28 between the first 30 and the second 32 ends is slideably connected to the bag body 12 at at least one connection point.

Additionally, the strap 28 may include a shoulder pad 40 and at least one backpack pad 42. For larger bags, the strap 28 may include a securing strap 44 to place additional support across a user's sternum and/or a retractable hip belt 45 for additional weight redistribution which may be integrally formed with the strap.

Figure 2:
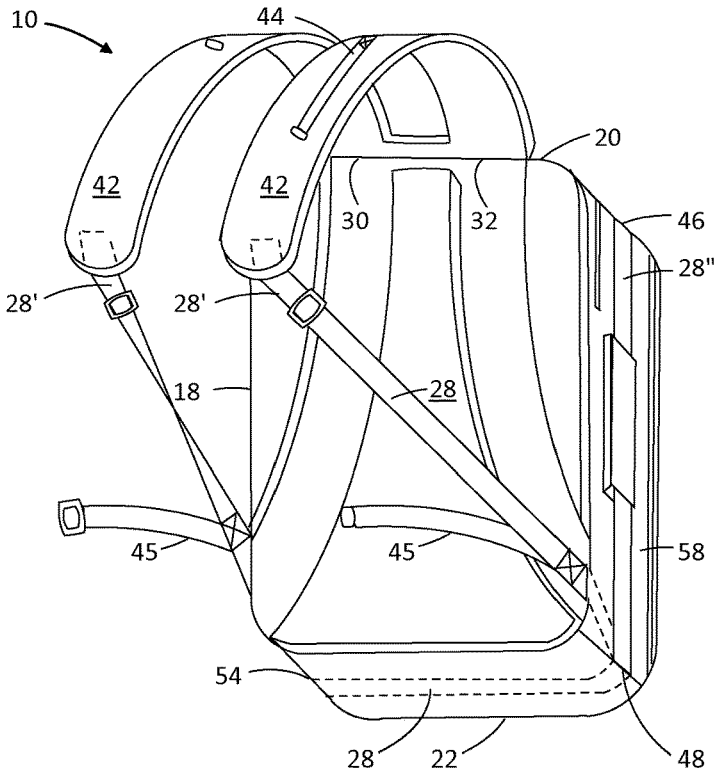
FIG. 2 is a perspective view of the convertible shoulder bag and backpack of FIG. 1, showing the embodiment in a backpack configuration.
Figure 5:
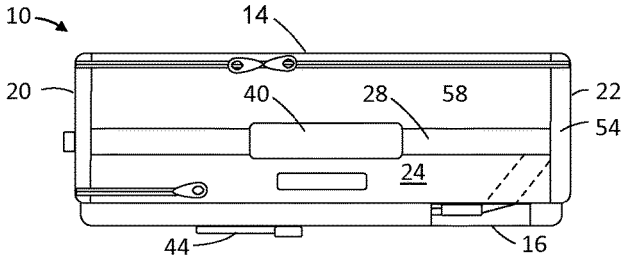
FIG. 5 is a top view of the embodiment of FIG. 3.
Figure 6:
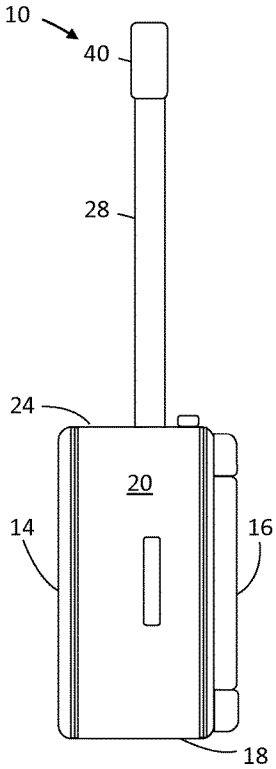
FIG. 6 is a first side view of the embodiment of FIG. 3.
Figure 8:
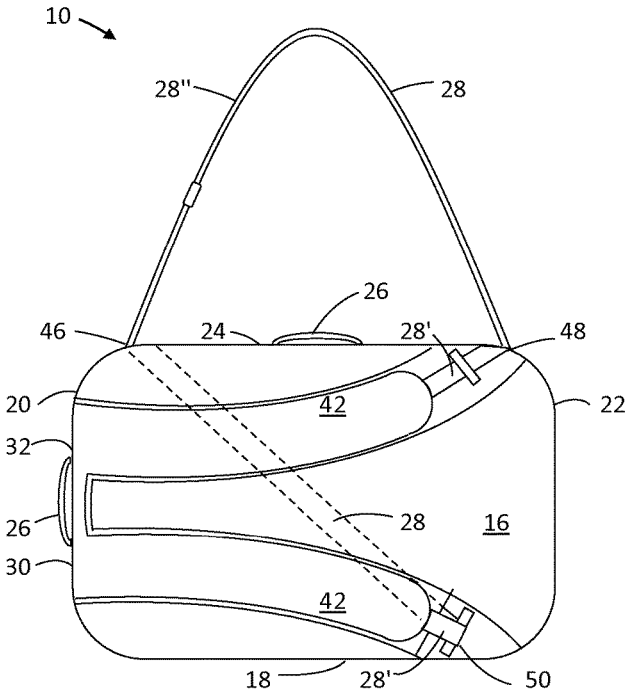
FIG. 8 is a rear view of another embodiment of the invention.
Figure 12:
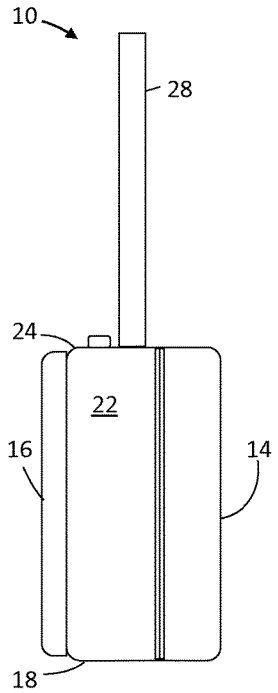
FIG. 12 is a second side view of the embodiment of FIG. 8.
Figure 9:
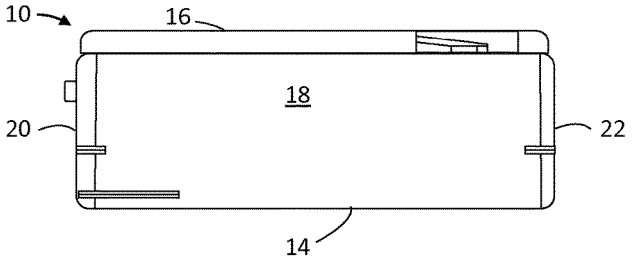
FIG. 9 is a bottom view of the embodiment of FIG. 8.

The strap 28 is configured to enable a wearer to alternate between a shoulder-bag configuration (as best seen in FIGS. 1, 3, 6, 7, 8, 10, 13, 15, 17, 20, 21, 22, 25 and 26) and a backpack configuration (as best seen in FIGS. 2 and 9) without disconnecting or reconnecting the strap.

In one embodiment, in the shoulder-bag configuration, a portion 28' of the strap 28 used in the backpack configuration rests along the back 16 panel and when in the backpack configuration, a portion of the strap 28" used in the shoulder-bag configuration rests along the top panel 24.

In the same or another embodiment, in the shoulder-bag configuration, a portion of the strap 28' used in the backpack configuration is not used as a portion of the strap 28" in the shoulder-bag configuration and when in the backpack configuration, a portion of the strap 28" used in the shoulder-bag configuration is not used as a portion of the strap 28' in the backpack bag configuration.

In the same or another embodiment, to convert the bag into the shoulder-bag configuration a portion of the strap 28 is pulled away from the top panel 24 and to convert the bag into the backpack configuration a portion of the strap is pulled away from the back panel 16.

Referring to FIGS. 8 to 12, in this embodiment, a portion of the strap between the first 30 and second 32 ends is slideably connected to the bag body 12 at first 46 and second 48 connection points positioned adjacent the top panel 24 and at a third connection point 50 positioned adjacent the second side panel 22. The connection points can be D-rings or other suitable slideable connection points as those skilled in the art will appreciate. Here, strap 28, runs inside bag body 12 underneath back panel 16 as shown in the dotted line from the corner of top panel 24 and first side panel 20 to the corner of bottom panel 18 and second side panel 22. Hiding the strap 28 as such, creates a visually appealing product, but those skilled in the art will appreciate, the strap may run on the outside of back panel 16.

Referring to FIGS. 3 to 7 and FIGS. 17 to 26, in this embodiment, a portion of the strap between the first 30 and second 32 ends is slideably connected to the bag body 12 at a first connection point 52 positioned adjacent the first side panel 20, a second connection point 54 positioned adjacent the second side panel 22, and a third connection point 56 positioned adjacent the bottom panel 18. Referring to FIGS. 8 to 15, connection points 52, 54, and 56 are sleeves incorporated into the bag body 12. In this instance, the strap 12 is hidden inside the bag body 12, again creating a visually appealing product. The strap 12 is only visible as the shoulder strap and backpack bag portions. Those skilled in the art will appreciate, however, that other connection points are contemplated as depicted in FIGS. 17 to 26 which may or may route the strap 28 on the inside or outside of bag body 12.

Referring to FIG. 1 and others, the connection point 46 is disposed at or proximate to a corner defined between the back panel 16, the first side panel 20, and the top panel 24; the connection point 48 is disposed at or proximate to a corner defined between the back panel 16, the second side panel 22, and the top panel 24; the connection point 50 is disposed at or proximate to a corner defined between the back panel 16, the second side panel 22, and the bottom panel 18. The first and second ends 30 and 32 are disposed along or proximate to an edge extending between the back panel 16 and the first side panel 20.

FIG. 1 also shows a fixed tote handle 26 affixed to the bag body 12 at the first side panel 20. The tote handle 26 is an optional feature, has a fixed length, and is not convertible. FIGS. 3 to 12 show a pair of the fixed tote handles 26, each of which is an optional feature. In the embodiments shown in FIGS. 3 to 12, one fixed tote handle 26 is affixed at the top panel 24 and the other fixed tote handle 26 is affixed at the first side panel 20.

Figure 13:
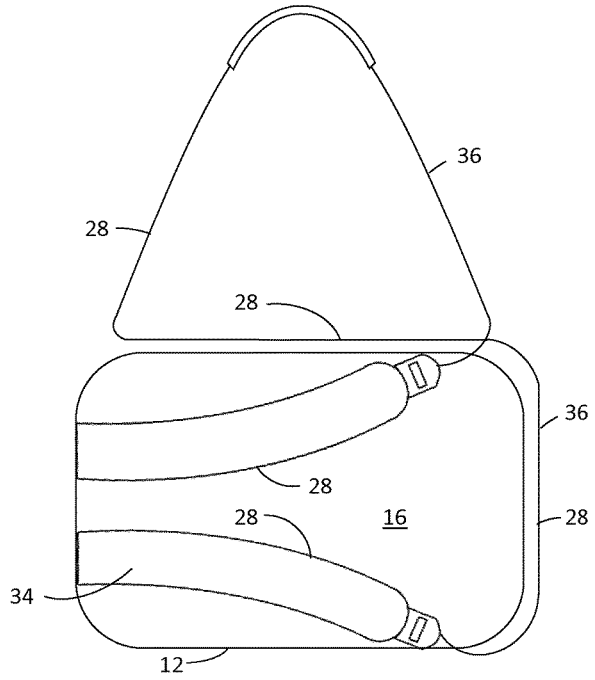
FIG. 13 is a schematic rear view of a strap routing for embodiments in the shoulder-bag configuration.
Figure 15:
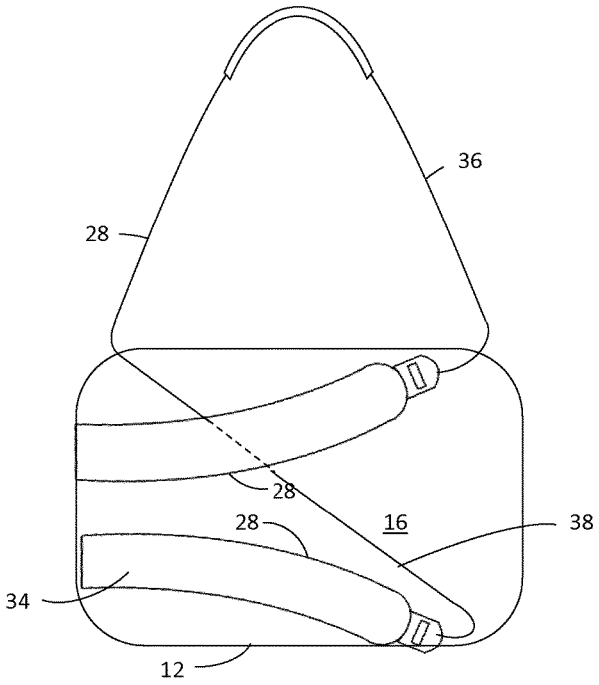
FIG. 15 is a schematic rear of another strap routing according to embodiments of the invention, shown in the shoulder-bag configuration.
Figure 14:
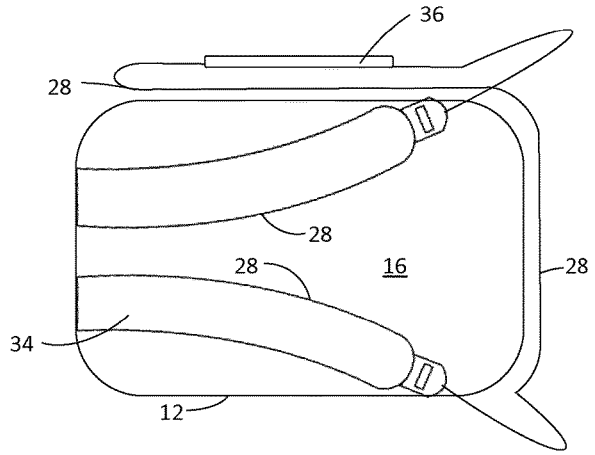
FIG. 14 is a schematic rear view of the strap routing of FIG. 13, shown in the backpack configuration.
Figure 16:
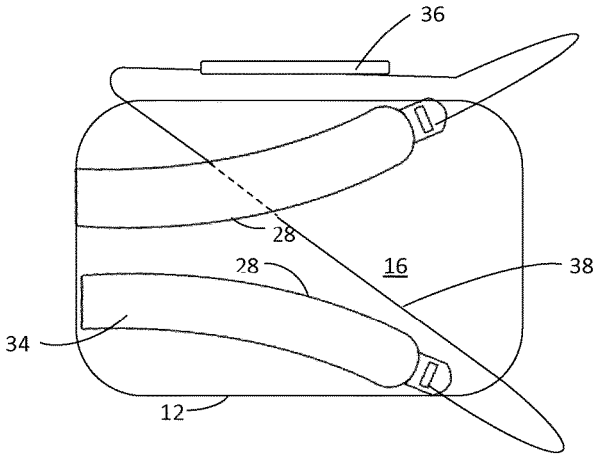
FIG. 16 is a schematic rear view of the strap routing of FIG. 15, shown in the backpack configuration.
Figure 19:
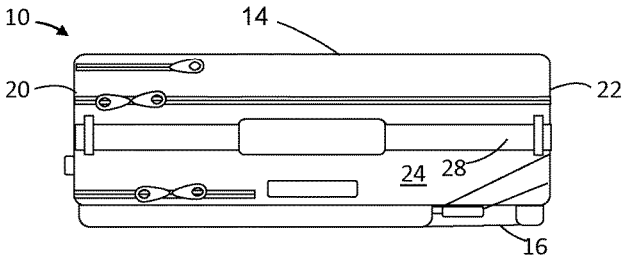
FIG. 19 is a top view of the embodiment of FIG. 17.
Figure 20:
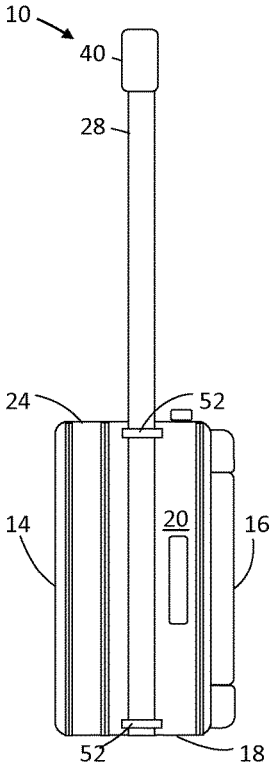
FIG. 20 is a first side view of the embodiment of FIG. 17.
Figure 17:
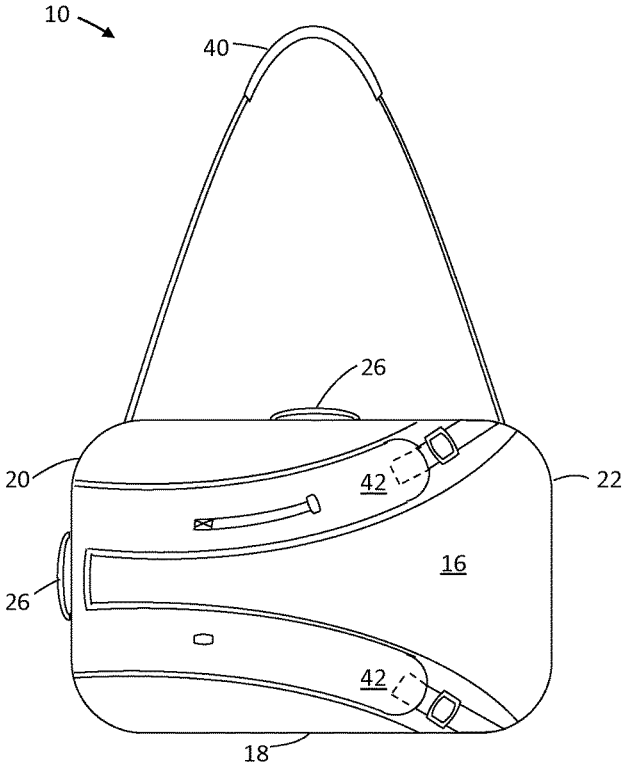
FIG. 17 is a rear view of another embodiment of the invention.
Figure 21:
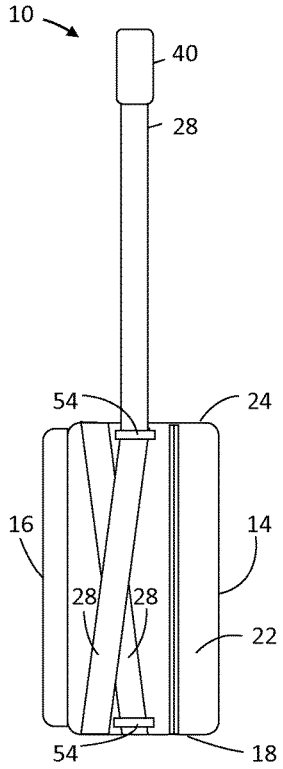
FIG. 21 is a second side view the embodiment of of FIG. 17.
Figure 18:
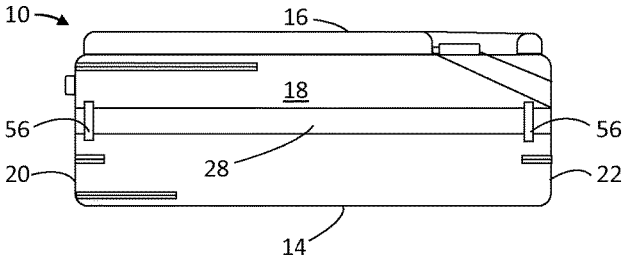
FIG. 18 is a bottom view of the embodiment of FIG. 17.
Figure 24:
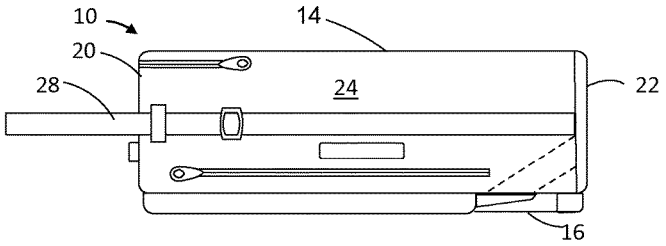
FIG. 24 is a top view of the embodiment of FIG. 22.
Figure 25:
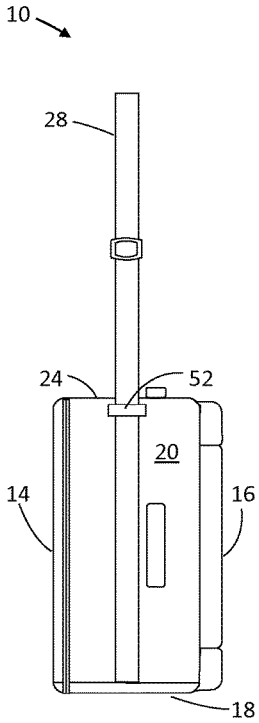
FIG. 25 is a first side view of the embodiment of FIG. 22.
Figure 22:
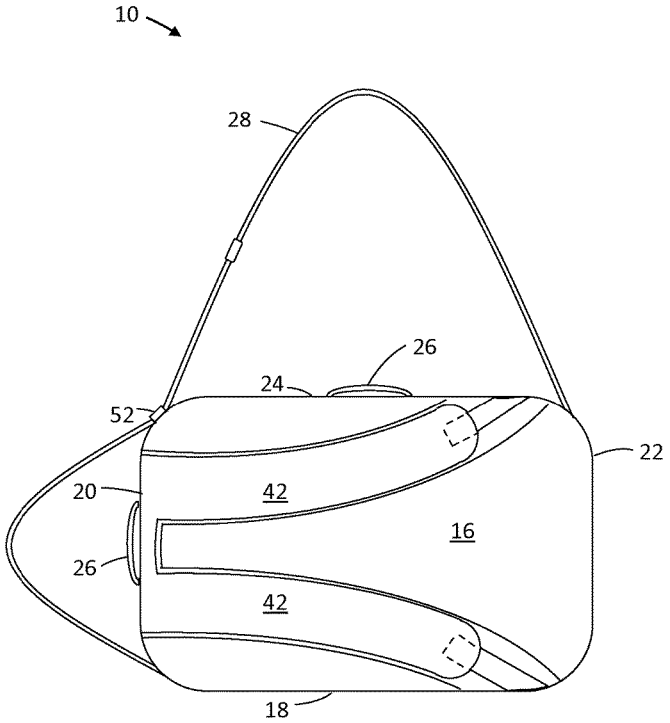
FIG. 22 is a rear view of another embodiment of the invention.
Figure 26:
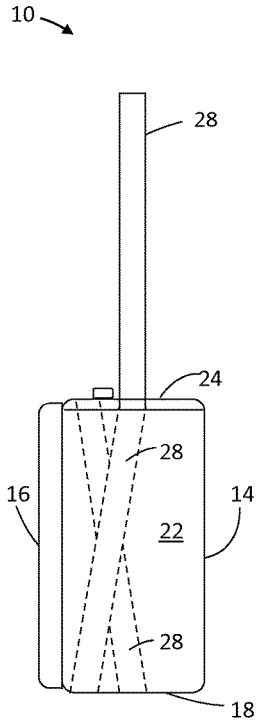
FIG. 26 is a second side view of the embodiment of FIG. 22.
Figure 23:
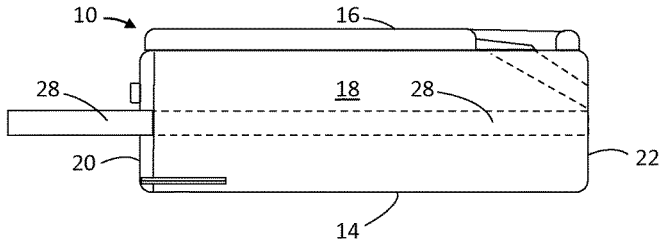
FIG. 23 is a bottom view of the embodiment of FIG. 22.

With reference to FIGS. 1 to 12, 13, 14, 15, and 16, the connection points 50 and 46 are diagonally opposing and form a pair of diagonally opposing connection points 50 and 46. As shown in FIGS. 13 and 15 and others, the continuous strap 28 defines a first portion 34 primarily useable in the backpack configuration, a second portion 36 primarily useable in the shoulder-bag configuration, and an interconnecting portion 38 disposed between the first and second portions 34 and 36. FIGS. 13 and 14 show the interconnecting portion 38 routed along the second side panel 22 and the top panel 20 between the diagonally opposing connection points 50 and 46. FIGS. 15 and 16 show the interconnecting portion 38 routed directly diagonally along the back panel 16 between the diagonally opposing connection points 50 and 46.

Figure 34:
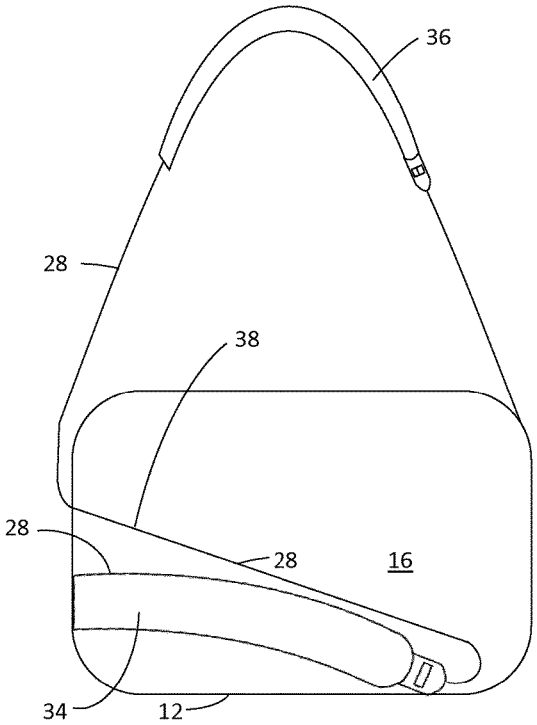
FIG. 34 is a schematic rear view of another strap routing according to embodiments of the invention, shown in the shoulder-bag configuration.
Figure 35:
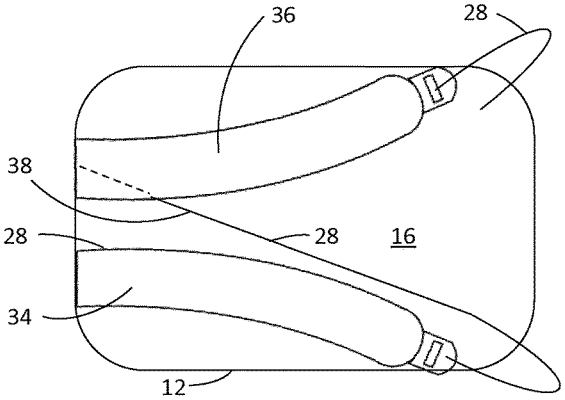
FIG. 35 is a schematic rear view of the strap routing of FIG. 34, shown in the backpack configuration.

Referring to FIGS. 34 and 35, in some embodiments the strap 28 is slidably connected to the bag body 12 at the second end 32. In such embodiments, the first portion 34 extends between a first pair of connection points 30 and 50, and the second portion 36 extends between a second pair of connection points 46 and 48. The first and second portions 34 and 36 are connected to each other via the interconnecting portion 38 that is slidably extending between a pair of diagonally opposing connection points 50 and 32. As shown in FIGS. 34 and 35, the second portion 36 can be made useable in both the shoulder-bag configuration and the backpack configuration. In the backpack configuration, the second portion 36 is useable as one backpack-strap portion closest to the top panel 24. In the shoulder-bag configuration, the second portion is useable as the shoulder-strap portion. The embodiment of FIGS. 34 and 35 includes one directly diagonal portion forming the interconnecting portion 38.

Figure 36:
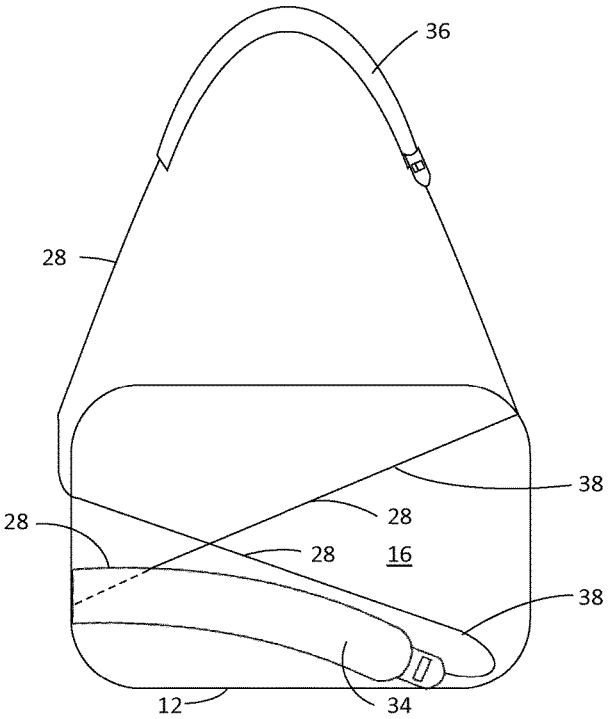
FIG. 36 is a schematic rear view of another strap routing according to embodiments of the invention, shown in the shoulder-bag configuration.
Figure 37:
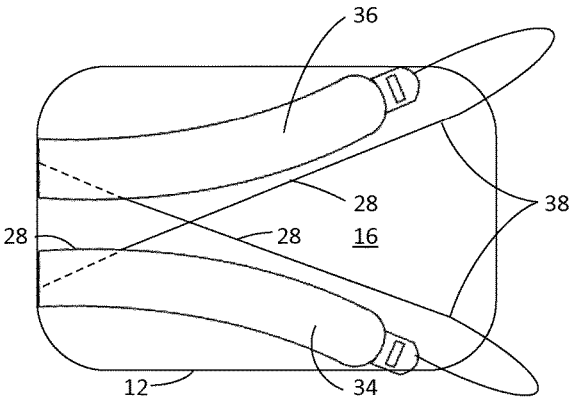
FIG. 37 is a schematic rear view of the strap routing of FIG. 36, shown in the backpack configuration.

Referring to FIGS. 36 and 37, in some embodiments the strap 28 is slidably connected to the bag body 12 at both the first and second ends 30 and 32. In addition to the first portion 34 extending between the connection points 30 and 50, the second portion 36 extending between the connection points 46 and 48, and the interconnecting portion 38 extending between the diagonally opposing connection points 50 and 32, there is also a second interconnecting portion 38 slidably extending between a second pair of the diagonally opposing connection points 30 and 48. The connection points 50 and 32 are diagonally opposite the connection points 30 and 48.

Figure 38:
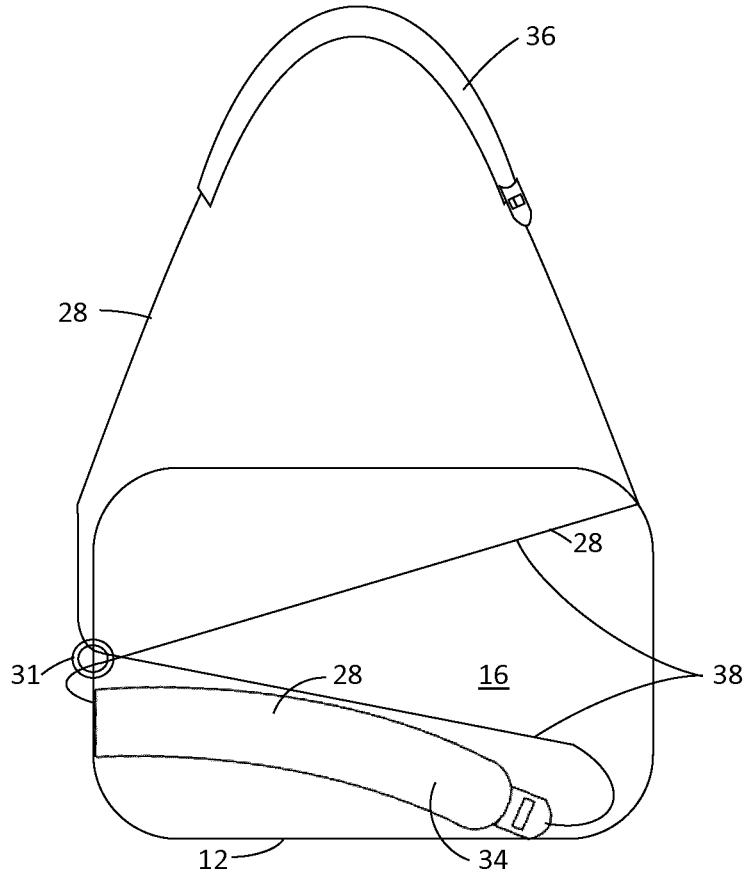
FIG. 38 is a schematic rear view of another strap routing according to another embodiment of the invention, shown in the shoulder-bag configuration.
Figure 39:
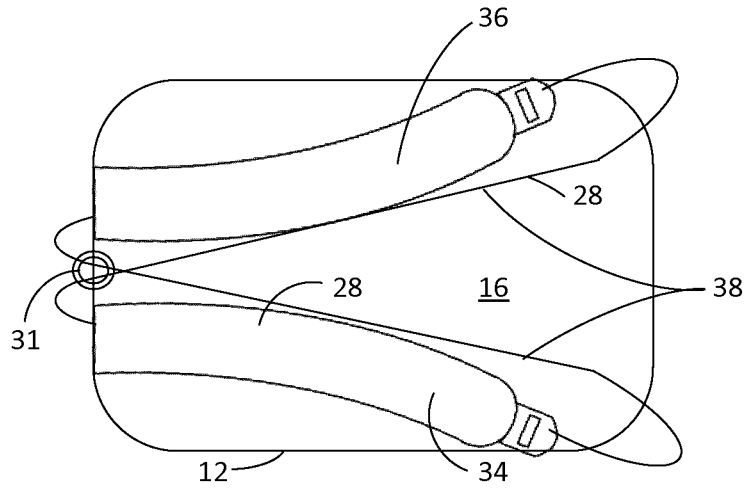
FIG. 39 is a schematic rear view of the strap routing of FIG. 38, shown in the backpack configuration.
Figure 42:
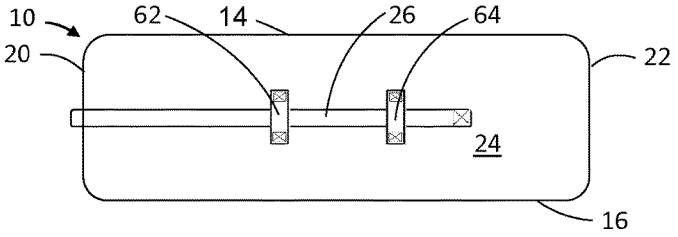
FIG. 42 is a top view of the embodiment of FIG. 40.
Figure 43:
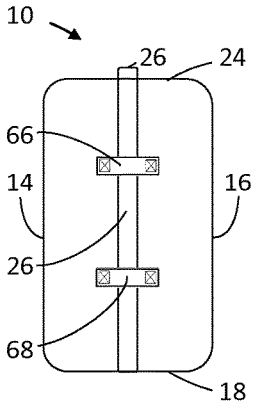
FIG. 43 is a first side view of the embodiment of FIG. 40.

Referring to FIGS. 38 and 39, in some embodiments the first and second ends 30 and 32 are formed by a single connection point 31. As shown in FIGS. 38 and 39, the first portion 34, the second portion 36, and the first and second interconnecting portions 38 are slidably connected to the bag body 12 at the single connection point 31. The single connection point 31 is typically disposed at a central point along or in proximity to the edge extending between the back panel 16 and the first side panel 20. The single connection point 31 may be implemented by a ring, such as a metal, plastic or fabric ring that is typically attached to the bag body 12; a loop, such as a plastic or fabric loop that is attached at its ends to the bag body 12, or similar for example.

Referring to FIGS. 40 to 48, some embodiments effect a tote-bag configuration in which one, two, or more of the tote handles 26 are slidably connected to the bag body 12 such that a user is enabled to pull one or both of the tote handles 26 away from the bag body 12 and to retract the tote handles 26 against the bag body 12. In variations, one or more tote handles 26 may be combined with and connected to the strap 28 having at least one of a shoulder-strap portion and a first backpack portion. The shoulder-strap portion extends between the pair of connection points 46 and 48 (FIG. 1 and others), and the first backpack portion extends between the pair of connection points 30 and 50 (FIG. 1 and others). In some embodiments, the tote configuration is combined with the shoulder-bag configuration; in some embodiments, the tote configuration is combined with the backpack configuration; and in some embodiments, the tote configuration is combined with both the shoulder-bag configuration and the backpack configuration.

Figure 40:
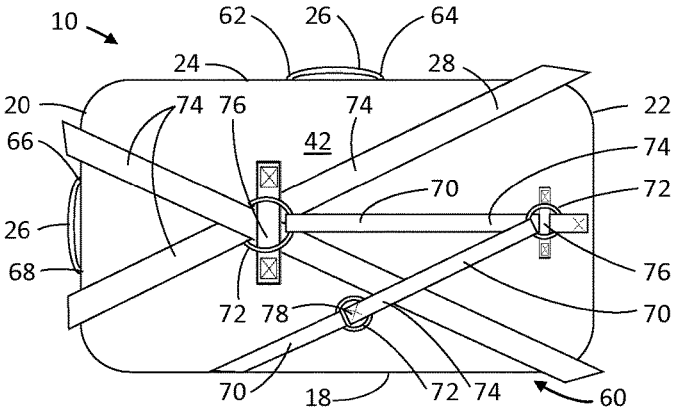
FIG. 40 is a rear cut-away view of an embodiment of the invention, showing an interconnecting portion with a length-multiplying factor of eight (8) between a first strap, which defines at least one of a shoulder-strap portion and a backpack portion, and a second strap defining a pair of tote handles.
Figure 44:
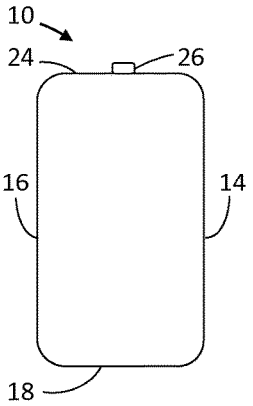
FIG. 44 is a second side view of the embodiment of FIG. 40.
Figure 41:
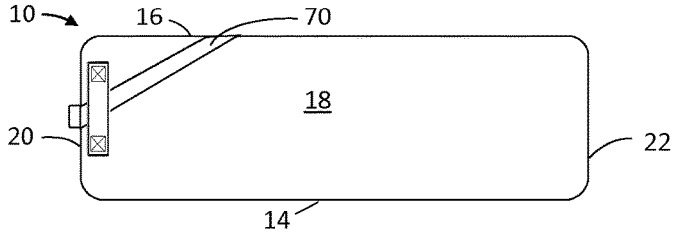
FIG. 41 is a bottom view of the embodiment of FIG. 40.
Figure 45:
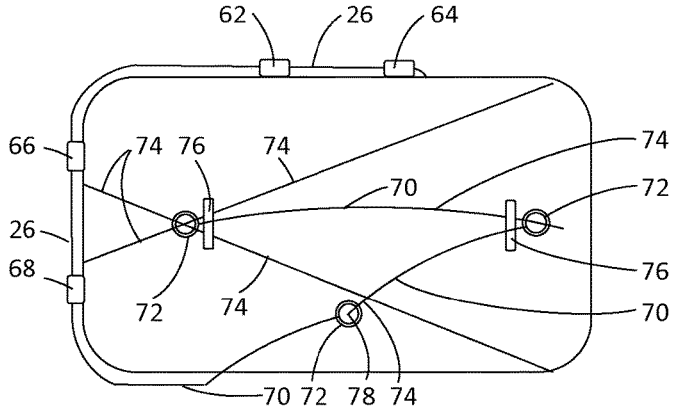
FIG. 45 is a schematic rear cut-away view of another strap routing according to the embodiment of FIG. 40, shown in a configuration other than a tote handle configuration.
Figure 46:
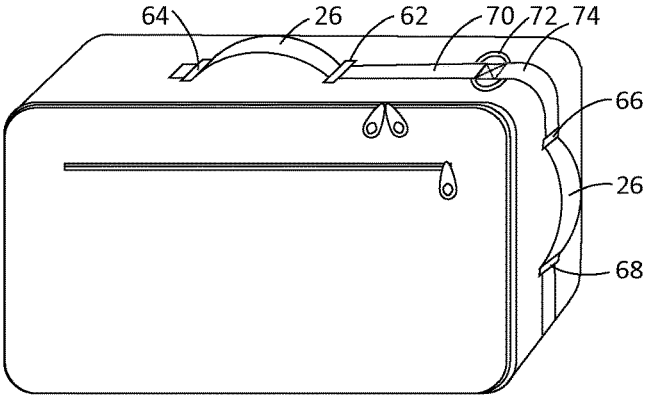
FIG. 46 is a front perspective view of an embodiment having a pair of tote handles.

FIG. 40 in particular shows the rear of the bag 10 with the back panel 16 removed to render visible an interconnecting portion 60 slidably extending between a first pair of connection points, selected among the connection points 30, 32, 46, 48, and 50, for at least one of the shoulder-strap portion and the first backpack portion and a second pair of connection points, selected among connection points 62, 64, 66, and 68, for at least one tote handle 26. The interconnecting portion 60 of FIG. 40 includes three pairs of segments providing a length-multiplying feature. In each pair of segments, a first segment 70 is terminated by a bifurcating member, such as the ring 72, that is slidably coupled to a corresponding second segment 74. The second segment 74 is restrained by a restraint, such as the loop 76 fixedly attached to the bag body 12 or the fixed attachment 78 of the second segment 74 to the bag body 12. When the first segment 70 is pulled in a direction away from its corresponding second segment 74, the ring 72 pulls on the second segment 74. Due to the loop 76 or the fixed attachment 78, the second segment 74 is forced to fold over at the ring 72, thereby doubling the length that the second segment 74 is moved relative to the movement of the first segment 70. In general, any number of pairs of segments can be employed in a cascade in which the second segment 74 of a given pair of segments is the first segment 70 of the subsequent pair of segments in the cascade. By including three pairs of segments, the embodiment of FIG. 40 effects a length-multiplication factor of eight (8) between the tote handle(s) 26 and the shoulder-strap portion and/or first backpack portion (not visible in FIG. 40).

Figure 47:
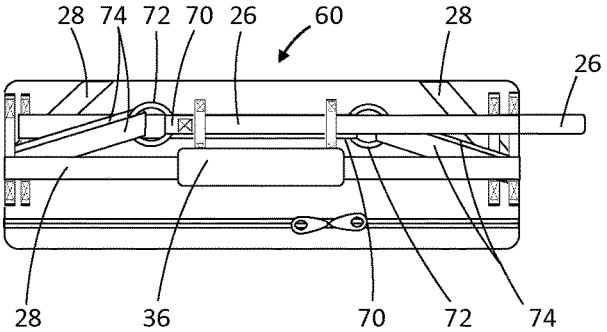
FIG. 47 is a top cut-away view of another embodiment of the invention, showing an interconnection portion with a length-multiplying factor of four (4) between a first strap, which defines a shoulder-strap portion and a backpack portion, and a second strap defining a pair of tote handles.
Figure 48:
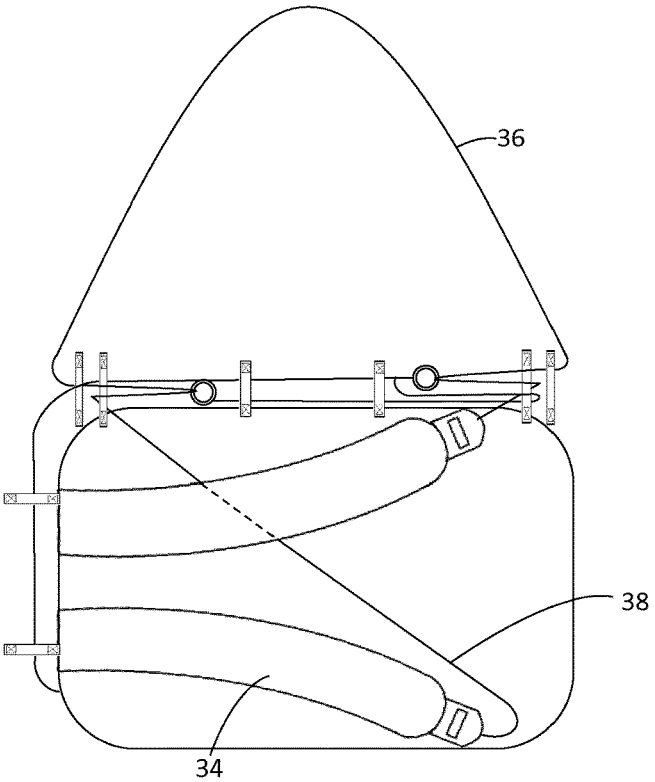
FIG. 48 is a schematic rear view of one possible strap routing according to the embodiment of FIG. 47, shown in the shoulder-bag configuration.

Referring to FIGS. 47 and 48, a tote bag in accordance with another embodiment is shown. The interconnecting portion 60 is disposed between the tote handles 26 and both the shoulder-strap portion and the backpack portions of the strap 28. The interconnecting portion 60 includes two pairs of segments providing a length-multiplying feature effecting a combined length-multiplication factor of four (4). In each pair of segments, the first segment 70 is terminated by a ring 72 that is slidably coupled to the coupled second segment 74. The second segment 74 is folded through the ring 72, with one folded portion 74 extending toward the backpack portion 34 and the other folded portion 74 extending toward the shoulder-strap portion 36. When the first segment 70 is pulled in a direction away from its corresponding second segment 74, the ring 72 pulls on the second segment 74 such that the second segment 74 is forced to fold over at the ring 72, thereby doubling the length that the second segment 74 is moved relative to the movement of the first segment 70. In the embodiment of FIG. 47, there are two pairs of segments on either side of the top-side tote handle 26, thereby providing a length-multiplying factor of four (4).

Operation

Figure 3:
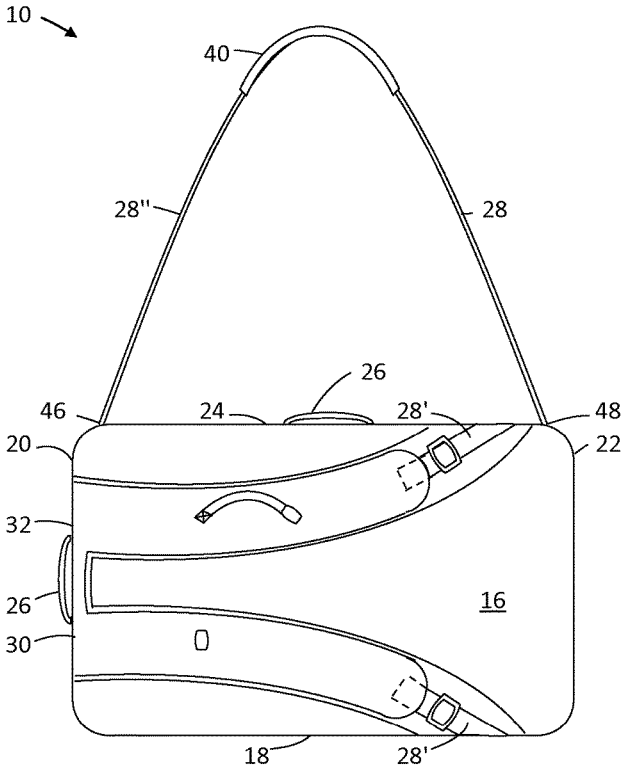
FIG. 3 is a rear view of another embodiment similar to that of FIG. 1, but having the addition of a pair of fixed tote handles.
Figure 7:
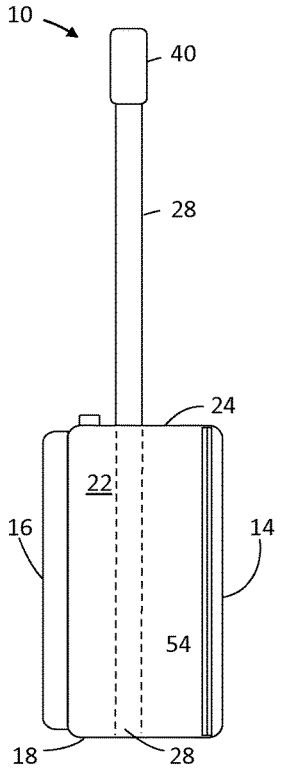
FIG. 7 is a second side view of the embodiment of FIG. 3.
Figure 4:
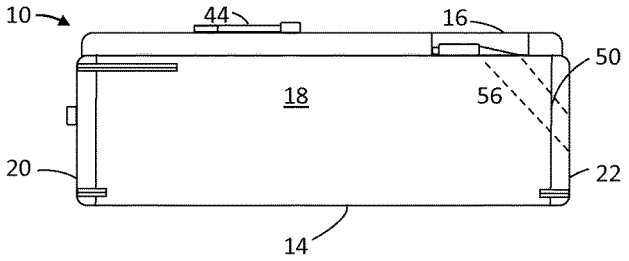
FIG. 4 is a bottom view of the embodiment of FIG. 3.
Figure 10:
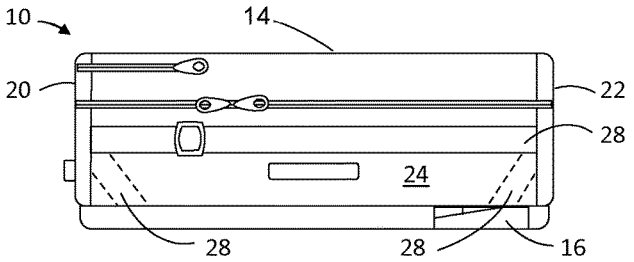
FIG. 10 is a top view of the embodiment of FIG. 8.
Figure 11:
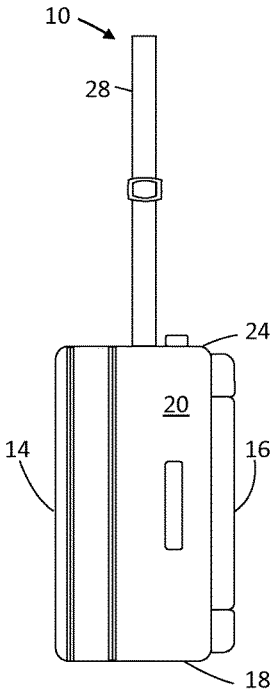
FIG. 11 is a first side view of the embodiment of FIG. 8

Referring to FIGS. 1, 2 and 3, in the shoulder-bag configuration, to change the bag to the backpack configuration, a user merely pulls on the backpack pads 42 (which are connected to the strap 28) away from back panel 16. By pulling the left backpack pad 42 away from back panel 16, the strap 28 from the corner of top panel 24 and first side panel 20 to the corner of bottom panel 18 and second side panel 22 now becomes the left-side backpack strap. Additionally, by pulling the right backpack pad 42 away from back panel 16 a portion of the strap 28 that was once part of the shoulder strap, now becomes the right-side backpack strap. To convert the backpack back into the shoulder-bag configuration, a user merely pulls on the strap 28 (which rested along the top panel 24 in the backpack configuration) to draw the strap back along the back panel 16.

Figure 27:
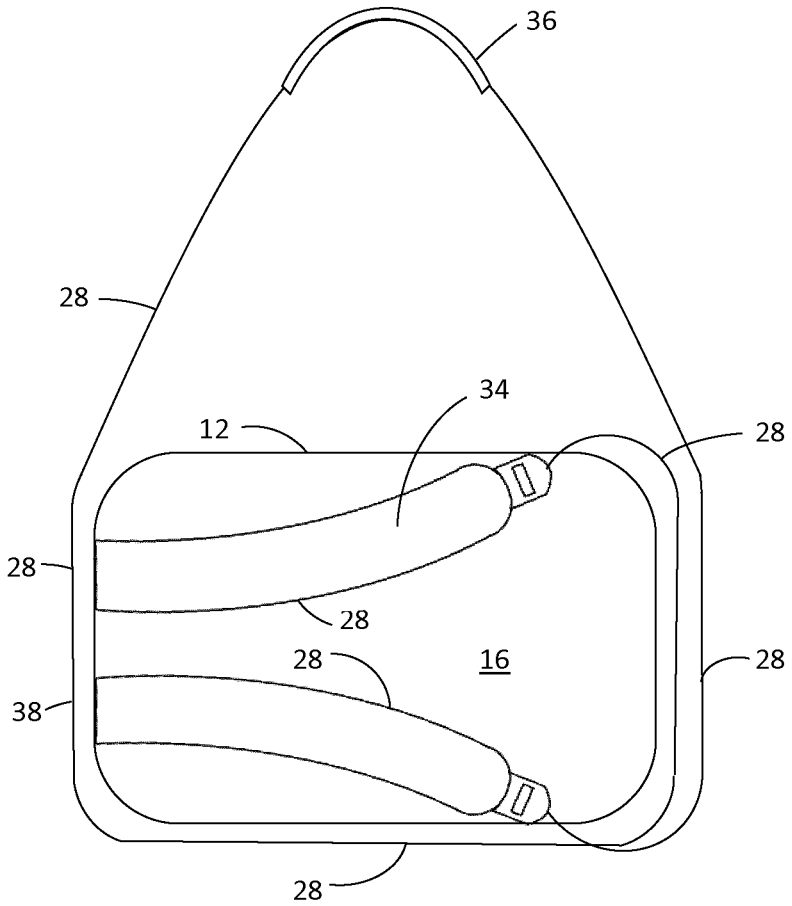
FIG. 27 is a schematic rear view of another strap routing according to embodiments of the invention, shown in the shoulder-bag configuration.
Figure 28:
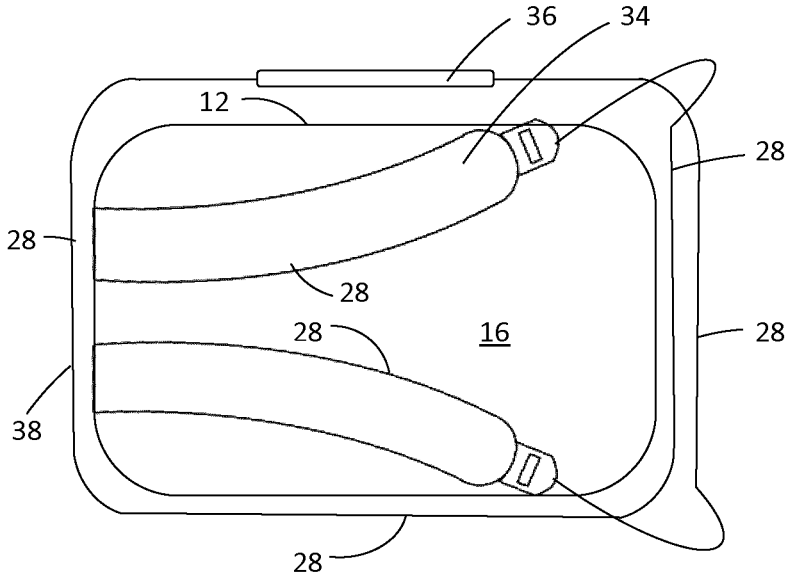
FIG. 28 is a schematic rear view of the strap routing of FIG. 27, shown in the backpack configuration.
Figure 31:
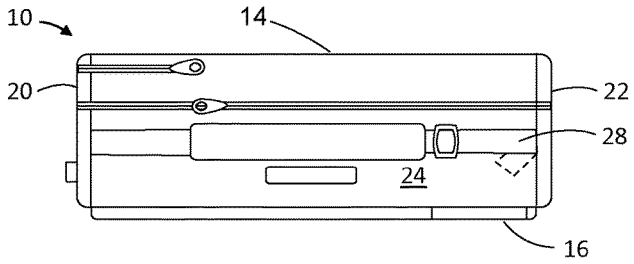
FIG. 31 is a top view of the embodiment of FIG. 29.
Figure 32:
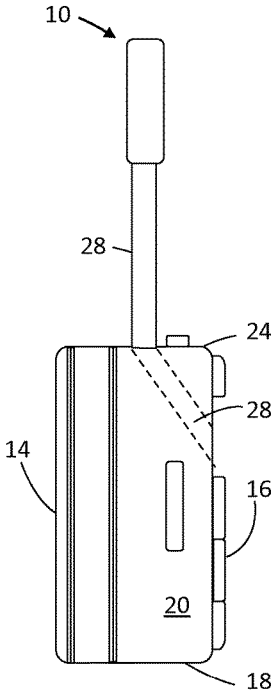
FIG. 32 is a first side view of the embodiment of FIG. 29.
Figure 29:
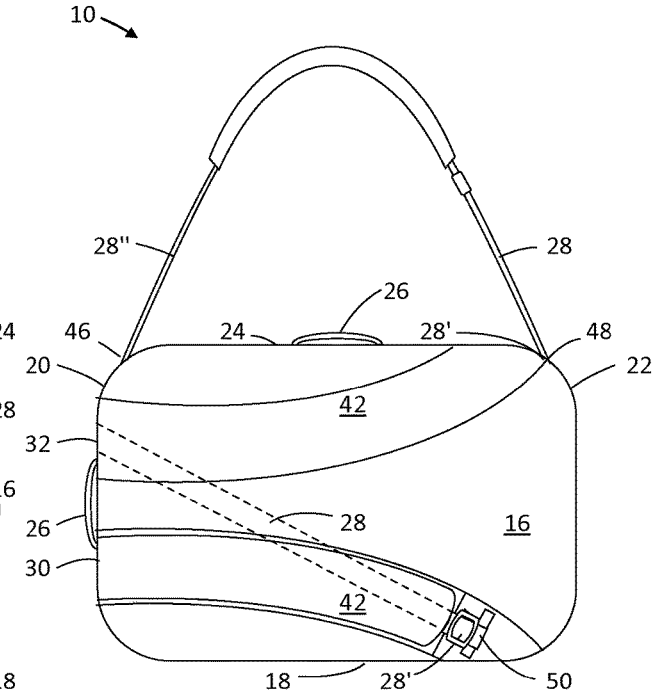
FIG. 29 is a rear view of another embodiment of the invention.
Figure 33:
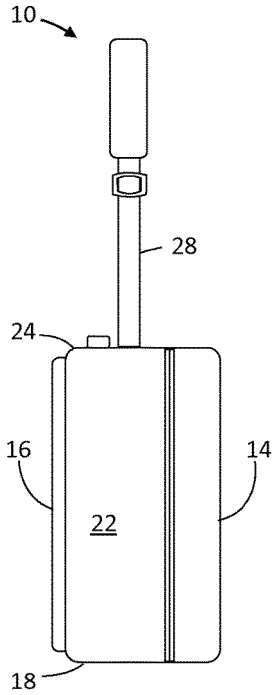
FIG. 33 is a second side view of the embodiment of FIG. 29
Figure 30:
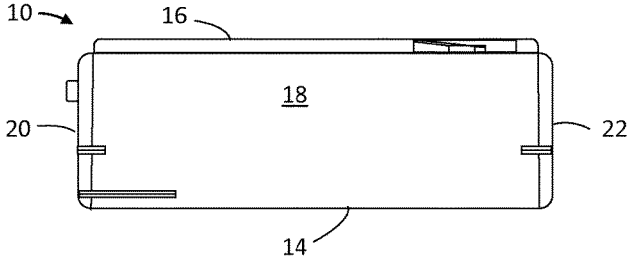
FIG. 30 is a bottom view of the embodiment of FIG. 29.

Referring to FIGS. 8, 9 and 27, in the shoulder-bag configuration, to change the bag to the backpack configuration, a user merely pulls on the backpack pads 42 (which are connected to the strap 28) away from back panel 16. By pulling the backpack pads 42 away from back panel 16, the strap 28 is drawn towards the top panel 24 and the remainder of the strap that is routed either inside or outside of the bag body 12 are used as the backpack straps. To convert the backpack back into the shoulder-bag configuration, a user merely pulls on the strap 28 (which rested along the top panel 24 in the backpack configuration) to draw the strap back along the back panel 16.

In embodiments having one or more slidable tote handles 26, such as the embodiments shown in FIGS. 40 to 48, to change from the shoulder-bag configuration or the backpack configuration to the tote bag configuration, a user merely pulls on a selected one of the tote handles 26 away from the bag body 12. By pulling the tote handle 26 away from the bag body 12, the strap 28 is drawn at a length-multiplying rate toward the bag body 12 to take up slack in the shoulder-bag portion and/or backpack portion of the strap 28. To convert the tote bag back into one of the shoulder-bag configuration or the backpack configuration, a user merely pulls on the strap 28 to draw the tote handle 26 at a length-dividing rate toward the bag body 12.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A convertible shoulder bag and backpack comprising:

(a) a bag body defining a front panel, a back panel opposite said front panel, a top panel extending between said front and back panels, a bottom panel opposite said top panel, a first side panel extending between said front and back panels, and a second side panel opposite said first side panel; and (b) a strap defining a first portion thereof extending between a first pair of connection points for connecting said first portion to said bag body, said strap defining a second portion thereof extending between a second pair of connection points for connecting said second portion to said bag body, said first and second portions being positionable adjacent the back panel and connected to each other via an interconnecting portion slidably extending between a pair of diagonally opposing said connection points such that slidably increasing the length of said first portion decreases the length of said second portion and slidably increasing the length of said second portion decreases the length of said first portion, said strap being configured to enable the convertible shoulder bag and backpack to be converted between a shoulder-bag configuration and a backpack configuration without disconnecting or reconnecting said strap.

2. The convertible shoulder bag and backpack of claim 1, wherein said strap comprises a retractable hip belt.

3. The convertible shoulder bag and backpack of claim 1, wherein said strap further comprises a securing strap.

4. The convertible shoulder bag and backpack of claim 1, wherein said first portion is shorter than said second portion when the convertible shoulder bag and backpack is in said shoulder-bag configuration, and wherein said first and second portions are substantially equal in length when the convertible shoulder bag and backpack is in said backpack configuration.

5. The convertible shoulder bag and backpack of claim 1, wherein said first pair of connection points comprises a first said connection point fixedly connecting said strap to said bag body, said first connection point being disposed proximate to an edge extending between said back panel and said first side.

6. The convertible shoulder bag and backpack of claim 5, wherein said first pair of connection points comprises a second said connection point slidably connecting said strap to said bag body, said second connection point being disposed proximate to a corner defined between said back panel, said second side panel, and said bottom panel.

7. The convertible shoulder bag and backpack of claim 5, wherein said second pair of connection points comprises third and fourth said connection points, said third connection point being fixedly attached to said bag body proximate to said edge, said fourth connection point slidably connecting said strap to said bag body, said fourth connection point being disposed proximate to a second corner defined between said back panel, said second side panel, and said top panel.

8. The convertible shoulder bag and backpack of claim 1, wherein said strap defines a shoulder-strap portion thereof extending between a third pair of connection points for connecting said shoulder-strap portion to said bag body, said shoulder-strap portion being connected to said first and second portions such that slidably increasing the length of said shoulder-strap portion decreases the length of said first and second portions and slidably increasing the combined length of said first and second portions decreases the length of said shoulder-strap portion, said shoulder-strap portion being longer than the length of each of said first and second portions when the convertible shoulder bag and backpack is in said shoulder-strap configuration, said third pair of connection points being respectively disposed in proximity to opposing ends of said top panel.

9. The convertible shoulder bag and backpack of claim 8, wherein said first pair of connection points comprises a first said connection point fixedly connecting said strap to said bag body, said first connection point being disposed proximate to an edge extending between said back panel and said first side panel, and wherein said second pair of connection points comprises a second said connection point disposed proximate to said edge and fixedly connecting said strap to said bag body.

10. The convertible shoulder bag and backpack of claim 8, wherein said first pair of connection points comprises a third said connection point slidably connecting said strap to said bag body, said third connection point being disposed proximate to a corner defined between said back panel, said second side panel, and said bottom panel, said second pair of connection points comprising a fourth said connection point slidably connecting said strap to said bag body, said fourth connection point being disposed proximate to a second corner defined between said back panel, said second side panel, and said top panel.

11. The convertible shoulder bag and backpack of claim 1, wherein said first and second portions are connected to each other via a second interconnecting portion slidably extending between a second pair of diagonally opposing said connection points opposite said pair of diagonally opposing connection points.

12. The convertible shoulder bag and backpack of claim 11, wherein each said connection point of said first and second pair of connection points slidably connects said strap to said bag body.

13. The convertible shoulder bag and backpack of claim 12, wherein said first pair of connection points comprises a first said connection point disposed proximate to an edge extending between said back panel and said first side panel, and comprises a second said connection point disposed proximate to a corner defined between said back panel, said second side panel, and said bottom panel.

14. The convertible shoulder bag and backpack of claim 13, wherein said second pair of connection points comprises a third said connection point disposed proximate to said edge, and comprises a fourth said connection point disposed proximate to a second corner defined between said back panel, said second side panel, and said top panel.

15. The convertible shoulder bag and backpack of claim 14, wherein said first and second connection points are formed by a single said connection point.

16. The convertible shoulder bag and backpack of claim 1, further comprising a tote strap defining a tote handle thereof extending between a third pair of connection points for connecting said tote handle to said bag body, said tote strap being connected to said first and second portions such that slidably increasing the combined lengths of said first and second portions by an amount decreases the length of said tote handle by said amount or by a diminished amount less than said amount and slidably increasing the length of said tote handle by a tote amount decreases the combined lengths of said first and second portions by said tote amount or by a magnified amount greater than said tote amount.

17. A convertible tote bag comprising:

(a) a bag body defining a front panel, a back panel opposite said front panel, a top panel extending between said front and back panels, a bottom panel opposite said top panel, a first side panel extending between said front and back panels, and a second side panel opposite said first side panel;

(b) a first strap defining a first portion thereof extending between a first pair of connection points for connecting said first portion to said bag body, said first portion comprising at least one of a shoulder-strap portion and a first backpack portion; and (c) a second strap defining a tote handle thereof extending between a second pair of connection points for connecting said tote handle to said bag body, said first and second straps being connected to each other via an interconnecting portion slidably extending between said first and second pairs of connection points such that slidably increasing the length of said tote handle by a first amount decreases the length of said first portion by said first amount or by a magnified amount greater than said first amount and slidably increasing the length of said first portion by a second amount decreases the length of said tote handle by said second amount or by a diminished amount less than said second amount, the convertible tote bag being convertible between a tote-bag configuration and at least one of a shoulder-bag configuration and a backpack configuration without disconnecting or reconnecting either of said first and second straps.

18. The convertible tote bag of claim 17, wherein said interconnecting portion comprises first and second segments thereof, said first segment terminating in a bifurcating member slidably coupled to said second segment such that said second segment is folded by said bifurcating member when said bifurcating member is moved by said first segment in a direction away from said second segment.

19. The convertible tote bag of claim 18, comprising a restraint fixedly attached to said bag body for restraining said second segment when said bifurcating member is moved in said direction.

20. The convertible tote bag of claim 18, further comprising a plurality of cascading pairs of said first and second segments such that said second segment of one said pair is said first segment of a subsequent said pair.

21. The convertible tote bag of claim 17, wherein said magnified amount is eight times said first amount.

22. The convertible tote bag of claim 17, wherein said magnified amount is four times said first amount.

23. The convertible tote bag of claim 17, wherein said second strap defines a first said tote handle disposed at said top panel and a second said tote handle disposed at said first side panel.

24. The convertible tote bag of claim 17, wherein said first portion comprises said first backpack portion, said first strap defines a second portion thereof extending between a second pair of connection points for connecting said second portion to said bag body, said first and second portions being connected to each other via an interconnecting portion slidably extending between a pair of diagonally opposing said connection points such that slidably increasing the length of said first portion decreases the length of said second portion and slidably increasing the length of said second portion decreases the length of said first portion, said first strap being configured to enable the convertible tote bag to be converted between a shoulder-bag configuration and a backpack configuration without disconnecting or reconnecting said first strap.

* * * * *